United States Patent [19]

Flippin

[11] 4,040,631

[45] Aug. 9, 1977

[54] GOLF CLUB SWING GUIDE

[76] Inventor: Jarvis F. Flippin, 2146 School St., Winston-Salem, N.C. 27105

[21] Appl. No.: 698,364

[22] Filed: June 22, 1976

[51] Int. Cl.[2] ..... A63B 69/36

[52] U.S. Cl. ..... 273/186 A; 273/186 C; 273/194 R

[58] Field of Search ..... 273/193, 194, 186, 183 D, 273/163, 164, 165, 191, 192

[56] References Cited

U.S. PATENT DOCUMENTS

| | | | |
|---|---|---|---|
| 2,630,012 | 3/1953 | Walker | 273/186 A |
| 3,132,865 | 5/1964 | Parker | 273/192 |
| 3,595,583 | 7/1971 | Oppenheimer | 273/191 B |
| 3,711,103 | 1/1973 | Seltzer | 273/191 A |

*Primary Examiner*—George J. Marlo
*Attorney, Agent, or Firm*—James C. Wray

[57] ABSTRACT

A pin is clamped at right angles to a golf club shaft and is aligned with a lower leading edge of the golf club head face. A circular plate is mounted perpendicularly on the pin so that the plate is aligned in the desired plane of swing of the golf club. The golfer has a visual indication of the desired plane of swing while using the device during practice sessions.

7 Claims, 6 Drawing Figures

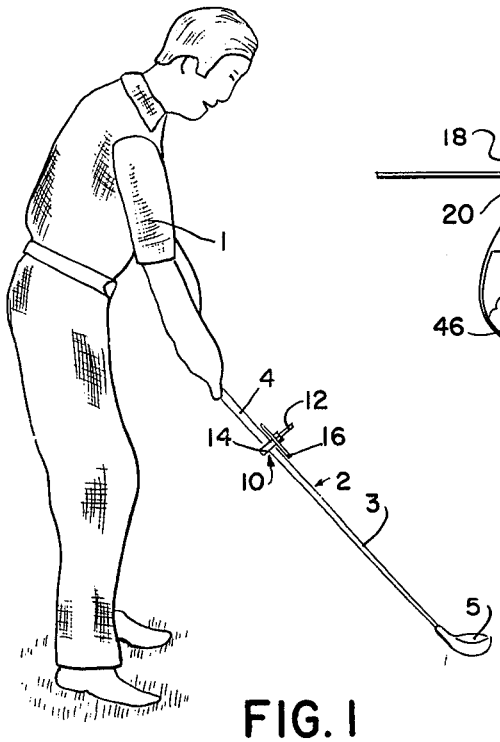
FIG. 1
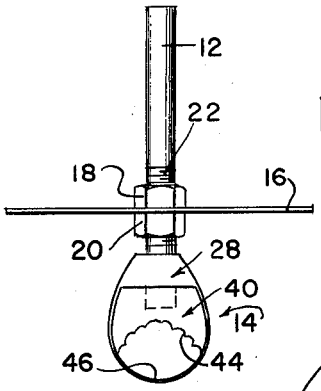
FIG. 3
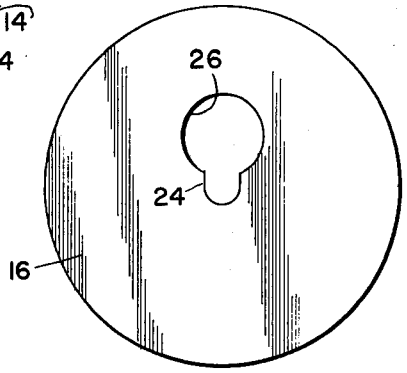
FIG. 4
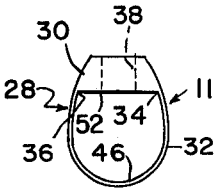
FIG. 5
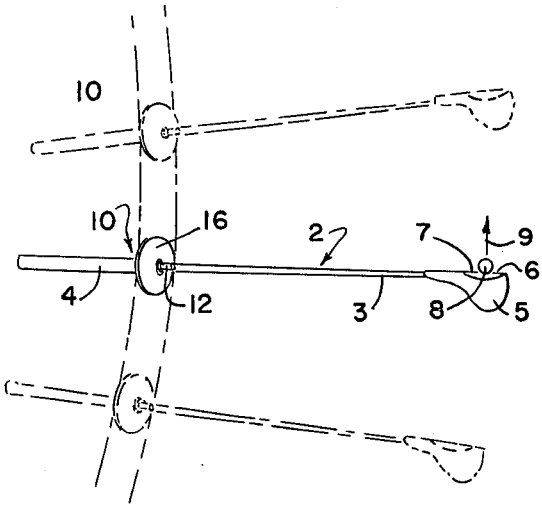
FIG. 2
FIG. 6
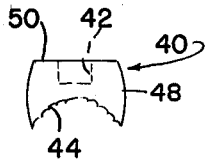

GOLF CLUB SWING GUIDE

BACKGROUND OF THE INVENTION

The handle end of the club is just as important as the club end. It is impossible to get the club to hit the ball correctly without first placing the handle in the correct position. When one studies a professional golfer's swing, what it comes down to is placing the handle end of the club in the right place and then letting the club do its work uninterrupted. One can look at the swing guide position indicator anywhere in one's back swing and tell where the club face is, being more aware of the handle end, club face direction and desired swing plane helps to make the right moves to place the handle end in the right place when one swings through.

It is recognized that in order to repeatedly hit golf balls well, it is necessary to "groove" a swing. In other words, it is necessary to work on and to create and to have a swing which has a desired profile and is repeatable.

While a swing may or may not vary for unique clubs, the repeatable nature of the swing or the grooving of the swing is necessary for the use of one or more clubs.

It has been determined that a useful swing is one in which the club shaft passes through an arc substantially within a plane which is parallel to the club shaft and perpendicular to a lower leading edge of a club head face.

Golf is a game of alignments. Hitting a ball over long distances from point to point requires that a ball be given a desired track. Giving the ball that desired track requires many mental computations and adjustments with trial and error practices, physical adjustments, and the creation of psychological and physiological memory patterns.

It has been observed that golf is a game of angles. When one approaches a ball to hit the ball from its situs, for example, a tee, to the target which may be the hole, one faces at an angle to the hole. Sometimes that angle is perpendicular; often it is not. The feet are placed at slightly different angles from the body and the upper body leans at still another angle. The arms extend at unique angles from the upper body, and the club shaft extends at still another angle. The club face has a loft, which is related to the shaft and the other angles at still a further angle. None of the aforementioned directions or angles are aligned with a line between the situs of the ball and the target and none appears to be perpendicular to that line.

A need exists for a device which will help one to form the physical and mental pattern necessary for perfecting a golf club swing and for having a visual observation of the desired swing.

PRIOR ART

Related United States patents are classified in Class 273, subclasses 163A, 163R, 164, and 193R and 194. Examples of the most pertinent U.S. Pat. Nos. are: 1,536,512; 1,603,850; 2,482,015; 2,543,722; 2,723,125; 2,747,878; 2,771,678; 2,822,614; 2,898,109; 2,910,297; 2,938,728; 2,950,115; 3,118,678; 3,198,525; 3,262,705; 3,273,892; 3,273,893; 3,424,462; 3,495,834.

None of these references shows or suggests this invention.

U.S. Pat. No. 2,723,125 is an example of a shaft-mounted device aligned with a direction of swing.

U.S. Pat. No. 3,262,705 describes a shaft-mounted device with a stubshaft 32 perpendicular to a shaft, and a directional device 43 mounted on the stubshaft. U.S. Pat. No. 3,198,525 has a similar showing.

U.S. Pat. No. 3,495,834 and 2,910,297 are examples of shaft-mounted devices aligned with the direction of the swing. A shaft-mounted plate is shown in patent 2,771,678.

U.S. Pat. No. 2,747,878 describes the desired swing plate.

The remainder of the patents describe golf club attachments of general interest.

SUMMARY OF THE INVENTION

It has been discovered that the only true angle which can be relied on as being at a known angle to a line between a situs of the ball and a target is a lower leading edge of the club face which is oriented perpendicular to a direction of desired ball travel.

It is desired to have that line exactly perpendicular to the direction of desired travel when the club face strikes the ball. It is further desired to have that line traveling in a predetermined arc immediately before contact and following ball contact. To create the desired arc of travel, it is further desired to have the golf club shaft traveling in a plane which is perpendicular to a plane containing that edge of the club face. Because the golf club shaft is a round shaft, no visual cue of the desired plane is oridinarily presented. It is difficult to envision the desired plane while a golf club shaft is being tracked through that plane in practice sessions.

To provide a golf club swing guide, the inventor has created and developed an indicator plane to attach to the golf club shaft. The indicator plane is readily visually observed by the golfer and is parallel to the plane through which desirably the golf club shaft passes during the swing.

To create this desired indicator plane, the inventor has provided a pin on a golf club shaft near the handle and has mounted the pin in a plane which contains the pin as well as the lower leading edge of the golf club head face.

Desirably, the pin is mounted perpendicularly to the golf club shaft. The pin in itself demonstrates to the golfer a line which is perpendicular to the desired direction of travel of the golf ball. From this line which is readily observed by the golfer, the golfer may make alignments of his body and feet. The golfer may further readily observe that the line indicated by the pin is tracing an outer periphery of an imaginary substantially right cylindrical volume.

The swing plane reference plate is connected to the pin perpendicular to the pin, so that the shaft of the golf club is parallel to the swing plane reference plate. The swing plane reference plate is readily visually accessible to the golfer, and the golfer works on developing a swing so that the swing plane reference plate will always pass through a plane, at least during the critical portions of the swing which are immediately before and immediately following ball contact, when the club head is influential on the ball.

In a preferred embodiment, the swing head plane reference plate is a round disc with a central opening. The pin is received in the center opening. An auxiliary enlarged opening may be provided connected to the central opening so that retainers such as nuts threaded on the pin may be passed through the enlarged opening when the plate is mounted on the pin.

It is highly desirable to mount the swing reference plate and pin which comprise the golf club swing guide on the shaft of the golf club. Moreover, the swing guide is preferably mounted near the handle. Light weight of the mounting means and stability of the mount are of utmost importance. An unique problem is presented in that the mounting means must fit over a relatively large handle and then be secured to a relatively small shaft. The inventor has conceived and developed a clamping device which is particularly adapted to the golf club swing guide of the present invention.

The clamping device has a main body with a head and a band which extends from corners of the head to form a ring-like body. A movable element is positioned within the ring-like body and has a rearward curved clamping surface which is opposite a portion of the band remote from the head of the main body. Together, the remote portion of the band and the clamping surface of the movable element oppositely grip the article which is the golf club shaft. When the movable element is removed from the main body, the relatively large opening of the main body may freely pass over an enlarged object which is the handle of the golf club shaft. After the annular, ring-like main body of the clamp has been passed over the handle, the movable element is inserted. A threaded pin drives the movable element away from the head of the main body and urges the clamping surface of the movable element toward the distal or remote portion of the band, gripping the golf club shaft therebetween.

To accomplish the clamping relative movement of the movable element away from the head of the main body, the head and movable element are provided with aligned bores. Threads in one of the bores contact threads on a pin which bears against the main body and movable element and moves one with respect to the other as the pin is turned. In a preferred embodiment, the threads of the pin engage with threads of a hole extending through the head of the clamping device and a distal end of the pin freely turns within a counterbore in the movable element.

One object of this invention is the provision of a golf club swing indicator comprising a clamp for connecting to a shaft of a golf club, a pin connected to the clamp for extending outward from the clamp and shaft parallel to a line of a lower leading edge of a face of a golf club head attached to the shaft, and a plate connected to the pin, the plate having a plane perpendicular to a plane including the pin and the leading edge.

Another object of the invention is the provision of a golf club swing indicator having a pin perpendicular to the shaft and a plate mounted on the pin perpendicular to the pin, so that the plate is parallel to the shaft.

Another object of the invention is the provision of a golf club swing indicator with the clamp having a main body which surrounds the shaft and wherein the pin is connected to the main body and extends outward from the main body and the plate is slightly spaced outward from the main body of the clamp, connected to the pin.

An object of the invention is the provision of a golf club swing indicator clamp having a movable element positioned within a main body for moving within the main body against the shaft, with a pin extending through the main body of the clamp toward a shaft and engaging the movable element for moving the movable element toward the shaft.

Another object of the invention is the provision of a golf club swing indicator with an indicator plate positioned generally parallel to a golf club shaft.

The invention has as a further object the provision of a golf club swing indicator having a circular indicator plate with a central opening for mounting the plate on a pin attached to a shaft.

Another object of the invention is the provision of a clamp with a threaded pin which passes through a main body of the clamp, with internally threaded keeper means engaged with the thread on the pin to overlie and underlie a plate, thus gripping and tightly positioning the plate on the pin and wherein the main body of the clamp is threaded whereby the pin may be screwed into and out of the main body and wherein a movable element has a bore to receive an end of the pin, whereby turning the pin inward within the main body engages the pin with the bore, and further turning of the pin into the clamp moves the movable element toward a shaft.

Another object of the invention is the provision of a clamping apparatus having a ring-like element with a head and a band connected at opposite edge portions of the head, and the band and the head thereby forming an annular element, and a movable element positioned within the annular element adjacent the head and having a clamping surface opposite the head for cooperating with a portion of the band remote from the head for clamping an object therebetween and further comprising means connected to the head and to the movable element for moving the movable element away from the head toward the remote portion of the band.

The invention has as another object the provision of a clamp with a threaded pin connected to the head on a ring and to a movable element for moving the movable element away from the head towards a remote portion of the ring.

A further object of the invention is the provision of a clamp with a tapped opening for engaging a threaded pin, and a movable element having a counterbore opposite the tapped opening of the head for receiving an end of the pin and moving the movable element away from the head as the pin is turned through the head.

BRIEF DESCRIPTION OF THE DRAWINGS

FIG. 1 is a side elevational view of a golf club with a swing guide in use.

FIG. 2 is a plan view of the apparatus of FIG. 1.

FIG. 3 is a plan detail of the golf club swing guide including the clamp for clamping the guide to the golf club shaft.

FIG. 4 is a detail of a swing plane plate.

FIG. 5 is a detail of the main body of the clamp.

FIG. 6 is a detail of the movable element of the clamp.

DETAILED DESCRIPTION OF THE DRAWINGS

Referring to FIG. 1, a golfer is generally indicated by the numeral 1. The golfer is shown in a position of addressing a golf ball and is holding a conventional golf club 2, which has a shaft 3 interconnecting a handle 4 and a head 5. As shown in FIG. 2, the head 5 has a face 6 and a lower leading edge 7 which is perpendicular to a desired direction of travel 9 of ball 8.

A golf club swing guide 10 is attached to shaft 3 so that a golfer may learn to properly groove his swing during practice sessions.

Guide 10 has a pin 12 which extends perpendicularly to shaft 3. Pin 12 is mounted on a base clamp 14 which is secured to shaft 3 immediately below handle 4. Swing guide plate 16 is mounted perpendicularly on pin 12 by upper and lower keepers 18 and 20 which are secured to pin 12.

As shown in FIG. 2 it is desired to swing the club so that shaft 3 moves in a plane at least prior to and immediately subsequent to contact with the ball. So that the golfer can appreciate the plane, swing guide plate 16 is mounted parallel to the desired swing plane of shaft 3. Pin 12 is mounted on shaft 3 parallel to the golf club face lower leading edge 7 and perpendicular to the desired direction of travel 9 of ball 8. The golfer thus has a convenient reference on the shaft of the desired swing plane of the shaft and of a line perpendicular to ball travel.

As shown in FIG. 3, pin 12 which is approximately 3 inches long and one-fourth inch in diameter in a preferred embodiment, has a threaded portion 22 nearest the shaft. Preferably the pin is made out of a plastic material such as nylon, and retainers 18 and 20 are nylon nuts having complementary threads.

Plate 16 as shown in FIG. 4 is a thin plastic disc which may be round and which may be about 3½ inches in diameter. Plate 16 is provided with a central quarter inch hole 24 for receiving pin 12, and an enlarged hole 26 is provided in communication with hole 24, so that the plate may be passed over the retainer nuts 18 and 20, while they are on the pin. The plate is then slid between the spaced nuts, engaging the shaft in the central hole 24 before the retainer nuts 18 and 20 are tightened on the plate to secure the plate to the pin.

In a preferred embodiment, the clamping device has a main body 28 which comprises a head portion 30 and a band 32 which extends from corners 34 and 36 of the head. The head has a bore 38 which is tapped with threads complementary to the threads of portion 22 of pin 12.

Movable element 40 has a counterbore 42 which is one-fourth inch or slightly larger to receive the proximal end of pin 12. A curved clampling surface 44 cooperates with the remote portion 46 of band 32 to clamp the shaft. Curved sides 48 of the movable element bear against the curved insides of band 32. The flat surface 50 of the clamping element rests against inner flat surface 52 of head 30 when the clamp is not engaged. Turning pin 12 in head 30 moves the pin toward the band 32 and urges movable element 40 toward the distal portion 46 of the band, clamping the shaft between the remote portion 46 of band 32 and the curved clamping surface 44 of the movable element 40.

While the invention has been described and claimed with reference to specific embodiments, it will be obvious that modifications and variations may be made without departing for the scope of the invention. The scope of the invention is defined in the following claims.

I claim:

1. A golf club swing indicator comprising a clamp connected to the shaft of a golf club, an elongated pin connected to the clamp and extending a substantial distance forward from the clamp and golf club shaft parallel to a line of a lower leading edge of the face of the golf club head attached to the shaft, and a plate connected to the pin adjacent the lower end thereof, said plate defining a plane of substantial area perpendicular to said pin and leading edge so that a golfer in addressing a golf ball may use said plate and pin as an effective reference of the desired swing plane of the shaft and a line perpendicular to the desired direction of ball travel.

2. The golf club swing indicator or claim 1 wherein the pin is perpendicular to the shaft and wherein the plate is mounted on the pin perpendicular to the pin, so that the plate is parallel to the shaft.

3. The golf club swing indicator of claim 1 wherein the clamp has a main body which surrounds the shaft and wherein the pin is connected to the main body and extends outward from the main body, and wherein the plate is connected to the pin, slightly spaced outward from the main body of the clamp.

4. The golf club swing indicator of claim 3 wherein the clamp further comprises a movable element positioned within the main body for moving within the main body against the shaft, and wherein the pin extends through the main body of the clamp toward the shaft, and engages the movable element for moving the movable element toward the shaft.

5. The apparatus of claim 4 wherein an end of the pin which passes through a main body of the clamp is threaded, wherein internally threaded keeper means are engaged with the thread on the pin to overlie and underlie the plate, thus gripping and tightly positioning the plate on the pin and wherein the main body of the clamp is threaded whereby the pin may be screwed into and out of the main body and wherein the movable element has a bore to receive an end of the pin, whereby turning the pin inward within the main body engages the pin with the bore and further turning of the pin into the clamp moves the movable element toward the shaft.

6. The golf club swing indicator of claim 1 wherein the plate is positioned parallel to the golf club shaft.

7. The golf club swing indicator of claim 1 wherein the plate is circular with a central opening for mounting the plate on the pin.

* * * * *